US008453993B2

(12) United States Patent
Davis

(10) Patent No.: US 8,453,993 B2
(45) Date of Patent: Jun. 4, 2013

(54) POST REMOVAL DEVICE

(76) Inventor: Graeme Davis, Bayswater North (AU)

( * ) Notice: Subject to any disclaimer, the term of this patent is extended or adjusted under 35 U.S.C. 154(b) by 153 days.

(21) Appl. No.: 12/681,635

(22) PCT Filed: Oct. 5, 2007

(86) PCT No.: PCT/AU2007/001467

§ 371 (c)(1),
(2), (4) Date: May 5, 2010

(87) PCT Pub. No.: WO2009/043079

PCT Pub. Date: Apr. 9, 2009

(65) Prior Publication Data

US 2010/0213425 A1 Aug. 26, 2010

(51) Int. Cl.
*B66F 3/00* (2006.01)

(52) U.S. Cl.
USPC ..... 254/131; 254/120; 254/134; 254/133 R; 254/17; 254/127

(58) Field of Classification Search
USPC ..... 254/131, 134, 133 R, 120, 17, 127
See application file for complete search history.

(56) References Cited

U.S. PATENT DOCUMENTS

| | | | | |
|---|---|---|---|---|
| 1,541,306 | A * | 6/1925 | Young | 254/133 R |
| 2,055,942 | A * | 9/1936 | Novak | 188/67 |
| 2,369,195 | A * | 2/1945 | Wiertz | 254/120 |
| 2,511,175 | A * | 6/1950 | Pearson | 254/131 |
| 2004/0195848 | A1 | 10/2004 | Toensing | |

FOREIGN PATENT DOCUMENTS

| | | | |
|---|---|---|---|
| AU | 6365480 | A | 4/1982 |
| AU | 621899 | B2 | 3/1992 |
| AU | 2005201795 | A1 | 11/2005 |
| DE | 41 27 058 | C1 | 8/1992 |
| DE | 44 35 655 | C1 | 12/1995 |
| GB | 2 316 056 | A | 2/1998 |

* cited by examiner

*Primary Examiner* — Monica Carter
*Assistant Examiner* — Nirvana Deonauth
(74) *Attorney, Agent, or Firm* — Fitch, Even, Tabin & Flannery, LLP

(57) ABSTRACT

A post removal device (10), including a support (11), and a lever (12) which is rotatable about a fulcrum (13). The lever (12) extends on either side of the fulcrum (13) to define a first portion (14) and a second portion (15), whereby downward movement of the first portion (14) results in upward movement of the second portion (15). The second portion (15) is connected to a gripping arrangement (19) which includes a pair of post grippers (23), which are movable during rotation of the lever (12), from an open condition to a gripping condition. The extent of rotational movement of the lever (12) is sufficient for the grippers (23) to move from the open condition to the gripping condition and for the gripping arrangement (19) to be lifted with the grippers (23) in the gripping condition for lifting a post.

18 Claims, 5 Drawing Sheets

POST REMOVAL DEVICE

FIELD OF THE INVENTION

The present invention relates to a post removal device for removing posts from the ground.

BACKGROUND OF THE INVENTION

The present invention has been developed principally for the removal of posts known as "star pickets". This type of post has a cross-section comprising three planar members, which extend radially from a central axis and which are spaced apart equidistantly at 120°. Posts of this type are frequently used on building sites and in temporary installations such as sporting and other entertainment events. In most cases, the posts have to be removed after a period of time. Removing the post is often difficult, given that they are usually very firmly embedded in the ground, which usually also has had time to settle about the post.

Various devices have been proposed before to remove posts such as star pickets. See for example AU 2005201795 and U.S. Pat. No. 6,527,250. Applicant is not aware that the device of either of these prior art documents has met with commercial success.

SUMMARY OF THE INVENTION

It is an object of the invention to provide a post removal device that is relatively simple and effective to use.

According to the present invention there is provided a post removal device, including:

- a rigid support which defines a fulcrum
- a lever which is rotatable about the fulcrum through a substantially vertical plane
- the lever extending on either side of the fulcrum to define a first portion on one side and a second portion on the other side, whereby downward movement of the first portion results in upward movement of the second portion
- the second portion is connected to a gripping arrangement which includes a pair of post grippers
- the post grippers are movable relative to each other during rotation of the lever, from an open condition in which there is a space between the grippers sufficient to accept a post, and a gripping condition in which the grippers grip the post
- the extent of rotational movement of the lever is sufficient for the grippers to move from the open condition to the gripping condition and for the gripping arrangement to be lifted with the grippers in the gripping condition for lifting a post.

It is preferred that movement of the post grippers between the open condition and the gripping condition involves opposite rotational movement of each gripper, i.e. that the grippers rotate in opposite directions.

It is further preferred that each of the post grippers include a gripping surface for gripping a post and that that surface be a curved, serrated surface. Such a surface can provide extremely good gripping characteristics against opposite sides of a post.

In the embodiment in which the post grippers each rotate in opposite directions in moving between the open and gripping conditions, it is preferred that the surface of the grippers which grip the post move towards each other during the opposite rotation. Thus, the arrangement preferably is that the gripping surfaces are spaced from each other in the open condition and move towards each other during rotation to the gripping condition.

In one form of the invention, the grippers grip the post by extending one or more protrusions through openings formed in the post. However, in the preferred arrangement, it is preferred that the post grippers frictionally grip the post, with the frictional grip being sufficient for the post to be lifted and removed from the ground by lifting of the gripping arrangement.

In a more specific form of the invention, the gripping arrangement includes a pair of arms which are pivotably connected to the second portion of the lever and to a respective gripper. In this arrangement, each gripper can be rotatably mounted at a position spaced from the pivotal connection with the respective arm with the arrangement being such that the grippers are driven to rotate about the rotatable mounting by the arms during at least a portion of the rotational movement of the lever. In the preferred arrangement, rotational movement of the grippers occurs when the lever is close to the end of an upper stroke of its rotational movement.

In the above arrangement, a sliding member can be employed in sliding connection with the rigid support. In this arrangement, each of the second portion of the lever, the pair of arms, the sliding member and the grippers move together during sliding movement of that member and rotational movement of the grippers between the open and closed conditions occurs when the second portion and the pair of arms move relative to the sliding member. In this arrangement, sliding of the sliding member may terminate when the sliding member engages an abutment or stop and at that point, the second portion and the pair of arms can continue movement relative to the sliding member causing rotational movement of the grippers.

It is preferred that the first portion of the lever be significantly longer than the second portion. Preferably the ratio is greater than one to four and preferably closer to one to eight.

Preferably the rigid support is a post member, and the sliding member is a sleeve that extends about the post member. Preferably the post member is cylindrical and the sleeve is of an internal diameter which is greater than the external diameter of the post member. The sliding member can include a mounting portion for rotatably mounting each of the grippers and in one example, a mounting block is attached to the sleeve such as by welding, and the grippers are rotatably attached to the block.

For stable operation, it is preferred that the bottom end of the rigid member include a base and in one arrangement, the base can be a generally flat plate. The rigid member can be fixed to the plate at any suitable position but in the preferred arrangement, it is fixed at one edge, preferably a forward edge of the plate.

The extent to which the gripping arrangement can be lifted in the gripping condition can vary depending on the dimensions of the post removal device, but in one arrangement, only a small lift is required in the order of about 100 mm to 150 mm. Where a post requires a greater lift for removal, a second lifting movement can be applied and indeed, a plurality of lifting movements might be required for a typical post to be removed. However, the ease with which the post removal device of the invention can be employed makes this a simple procedure. It is to be noted, that many posts might be removable by hand upon a single lifting movement being applied by the post removal device, so that where post removal is being conducted by two labourers, one labourer can operate the post removal device and the other can lift the post after a lifting movement of the device has taken place.

BRIEF DESCRIPTION OF THE DRAWINGS

It will be convenient to hereinafter describe preferred embodiments of the invention with reference to the accompanying drawings. The particularity of the drawings is to be understood as not limiting the preceding broad description of the invention.

DETAILED DESCRIPTION OF THE PREFERRED EMBODIMENTS

Figure 1:
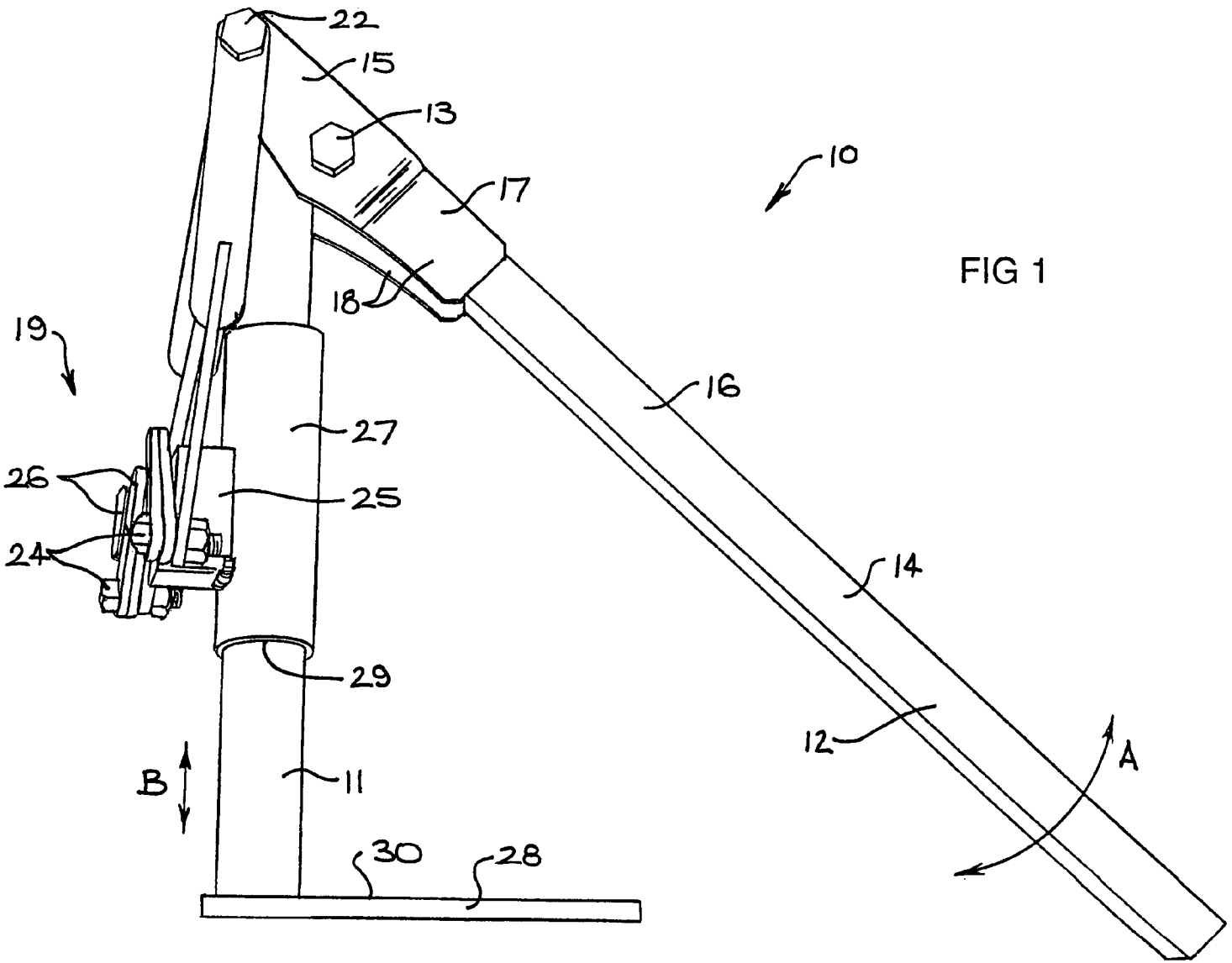
FIG. 1 is the side view of a post removal device according to one embodiment of the invention.

FIG. 1 is a side view of a post removal device according to one embodiment of the invention. The device 10 includes a rigid support 11 which defines a fulcrum in the form of an axle 13 about which a lever 12 is rotatable. The actual axle is not shown in FIG. 1, although the head of the axle 13 is shown. The axle 13 is connected to the support 11 and allows pivoting of the lever 12 thereabout in a substantially vertical plane shown by the arrow A. In FIG. 1, the lever 12 is at the bottom of a rotational stroke.

The lever 12 extends on either side of the axle 13 to define a first portion 14 on the right hand side and a second portion 15 on the left hand side according to FIG. 1. It is evident from FIG. 1, that downward movement of the first portion 14 will result in upward movement of the second portion 15 and vice versa.

The lever 12 is formed from a section 16 of square metal bar and a bifurcated section 17. The bifurcated section 17 includes a pair of arms 18 which extend to either side of the support 12 and connect with both the axle 13 and a gripping arrangement 19. This arrangement is more evident in FIG. 2 and reference will now be made to that figure.

The gripping arrangement includes a pair of arms 20 which are connected to the arms 18 via a second axle 22. The axle 22 is formed at the ends of the arms 18 in the second lever section 15 as shown in FIG. 1. The arms 20 extend to a pair of post grippers 23 and the connection between the arms 20 and the grippers 23 is a rotatable connection about pins 24. The grippers 23 are rotatably mounted to a mounting block 25 on spindles 26.

The block 25 is fixed to a sliding member 27 which is cylindrical and which fits about the support 11 for sliding movement. Thus, the sliding member 27 is movable in the direction shown by the arrow B (FIG. 1) along the support 11.

The device 10 further includes a plate base 28 on which the device can be supported.

Figure 3:
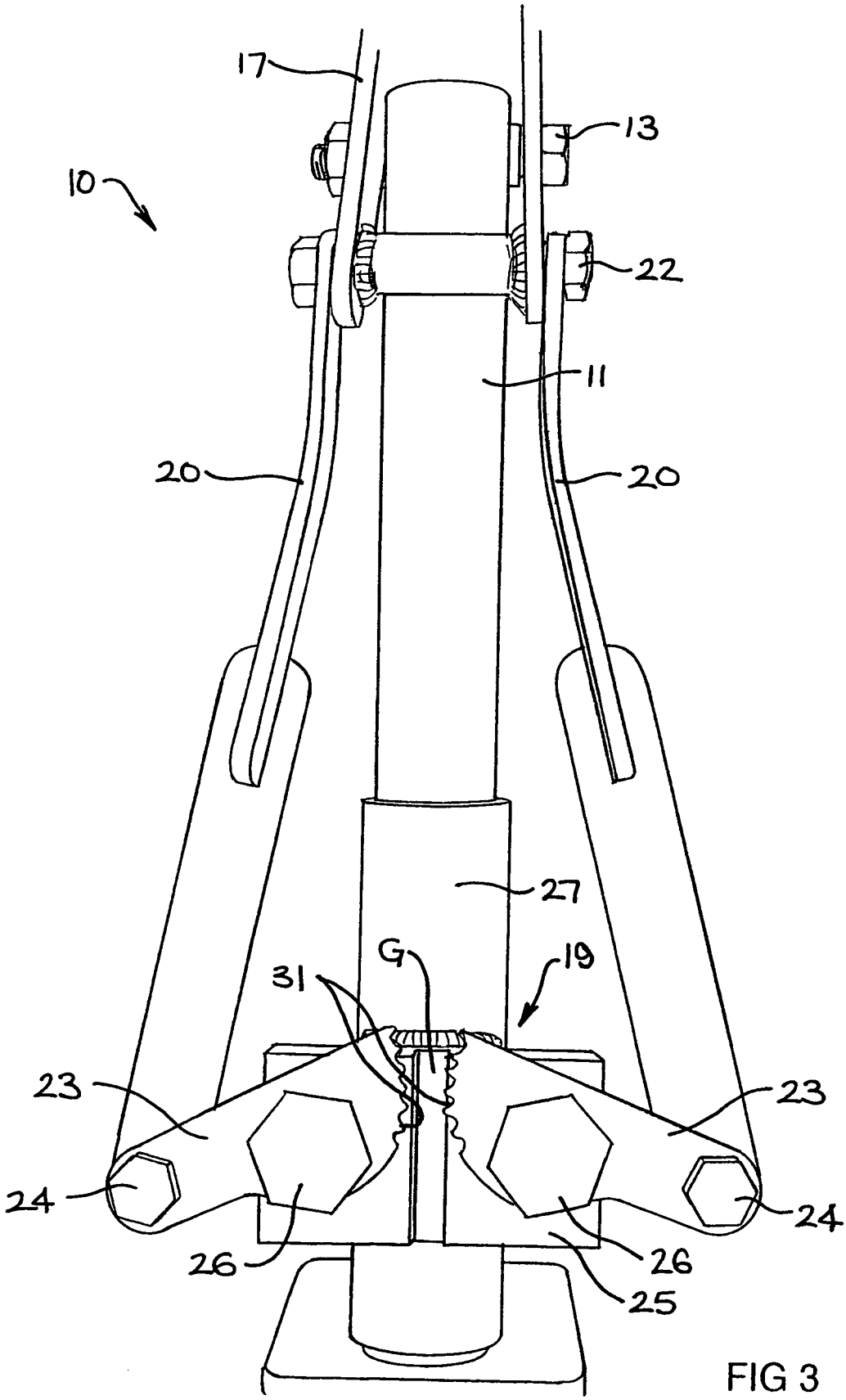
FIGS. 3 to 5 are front views of the post removal device of FIGS. 1 and 2 shown during a post lifting sequence.

Reference will now be made to the operation of the device 10 to remove a post. FIG. 3 illustrates the device 10 with the lever 12 in a raised position.

That is, and with reference to FIG. 1, the lever 12 has been rotated anti-clockwise about the axle 13 through approximately 90° to a raised position and by that rotation, the gripping arrangement 19 has been lowered on the support 11. Thus, each of the arms 20, the grippers 23, the mounting block 25, and the sliding member 27 have all moved downwardly relative to the support 11.

Sufficient rotation of the lever 12 will cause sufficient movement of the gripping arrangement 19 such that the bottom end 29 of the sliding member 27 will engage against the upper surface 30 of the base plate 28 (FIG. 1). Upon that engagement, further downward movement of the sliding member 27 relative to the support 11 is terminated. However, the lever 12 can continue to be rotated in an anti-clockwise direction and by that continued rotation, the arms 20 cause rotation of the grippers 23 about the pins 26 on which they are mounted to the mounting block 25. That rotation occurs, because of the fixed relationship between the mounting block 25 and the sliding member 27. Accordingly, with the lever 12 in its most upwardly rotated position shown in FIG. 3, the grippers 23 have rotated about the spindles 26 causing a gap G to open between the facing gripping surfaces 31. In that position, a post (not shown) can be inserted between the gripping surfaces 31 for later gripping.

It can be seen that in FIG. 3, the gap G is relatively small, but it has been arranged to be sufficient to grip a flange of a star picket. The gap G however can be arranged to be any suitable size so that posts of other construction can be removed by a device according to the invention. In other words, all that is necessary is to alter the various dimensions of the components of the device in order to make it suitable for different post constructions.

Having rotated the lever 12 to the position to generate the gap G shown in FIG. 3, and having placed the device to insert the flange of a star picket into the gap G and therefore between the grippers 23, the lever 12 is rotated downward in a clockwise direction and by that rotation, the grippers 23 are rotated about the spindles 26 to bring the gripping surfaces 31 into gripping engagement with opposite sides of the star picket flange. It is to be noted, that initial clockwise rotation of the lever 12 does not cause the sliding member 27 to lift away from the base plate 28 because of the weight of the sliding member 27 and the gripping arrangement 19.

Figure 4:
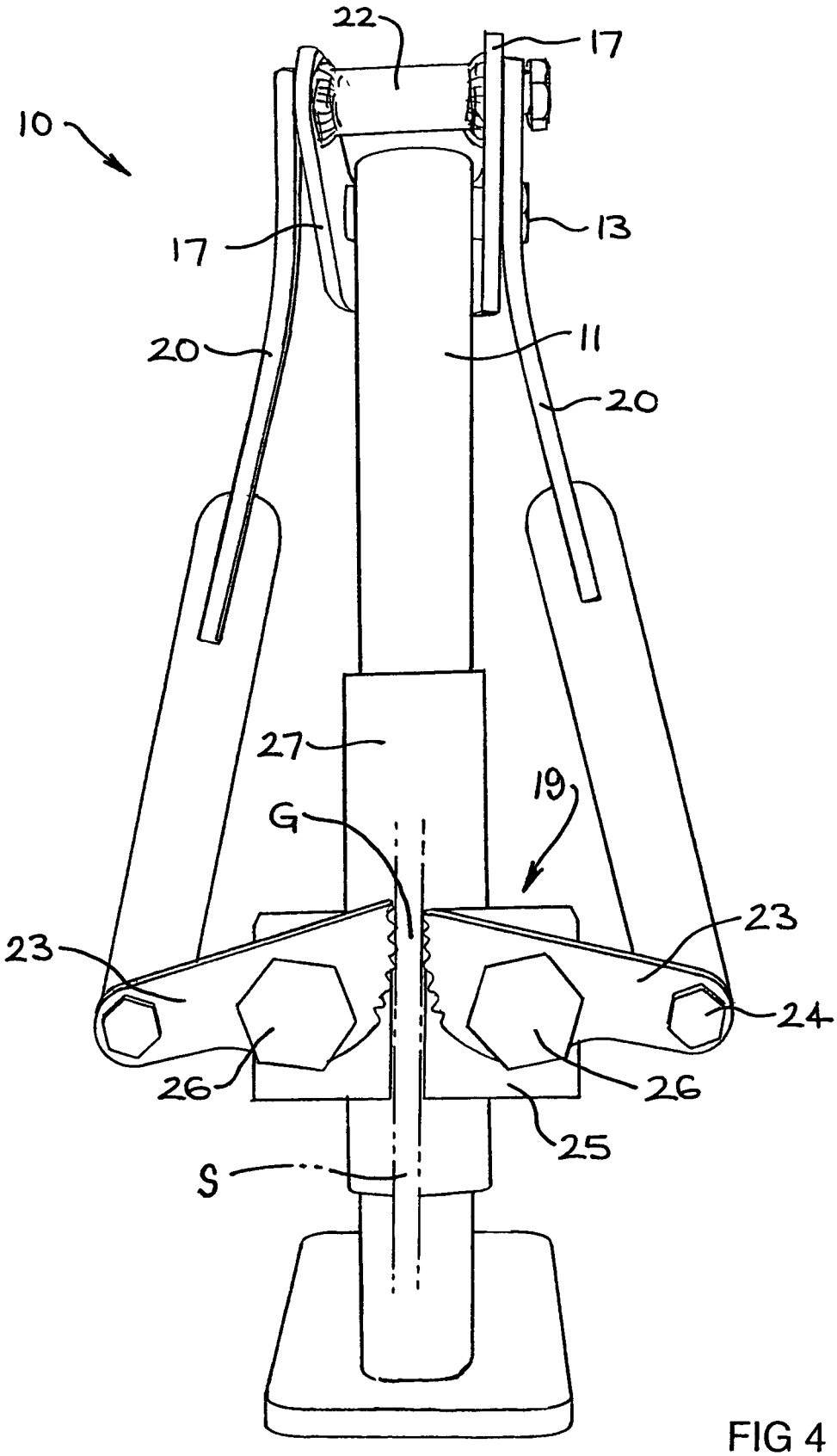
Figure 5:
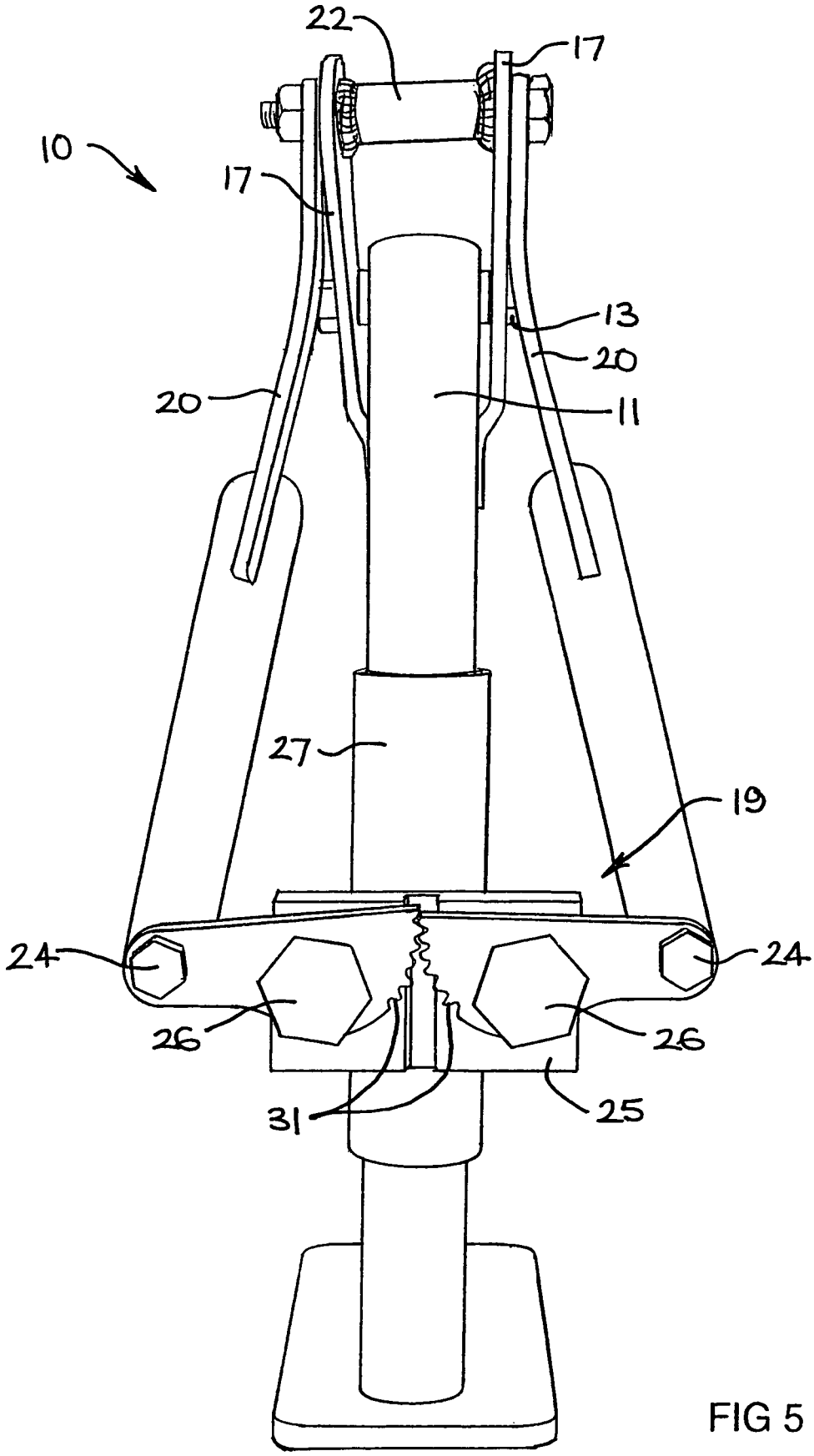

FIGS. 4 and 5 illustrate initial movement of the grippers 23 as the lever is initially rotated downwardly from the raised position of FIG. 3. FIG. 4 illustrates the grippers 23 actually gripping a section S of a star picket flange, while FIG. 5 shows movement of the grippers 23 without a star picket flange inserted therebetween, to fully illustrate gripper movement.

Thus, as the lever 12 is rotated downwardly, the grippers 23 rotate about the spindles 26 causing the gap G to reduce. As shown in FIG. 4, the grippers will grip opposite sides of the star picket flange S. As shown in FIG. 5, if the star picket flange is removed, the gripper surfaces 31 and the grippers 23 eventually engage each other. It is not always the case that this would occur, but with the dimensions of the device 10 illustrated, engagement between the gripping surfaces 31 will occur.

Once the gripping surfaces 31 have gripped the flange S of a star picket placed within the gap G, no further rotation of the grippers 23 about the spindles 26 can occur. Thus the gripping arrangement comprising the arms 20 and the grippers 23 are fixed against further relative movement. Thus, as the lever 12 is rotated further in the clockwise direction, the gripping arrangement 19 is lifted, with the sliding member 27 sliding upwards along the support 11. That upward movement causes the star picket to be lifted in the same direction.

The lever 12 can be rotated clockwise back to the position shown in FIG. 1 which is the maximum lifted position of the grippers 23. If that is not sufficient to remove the star picket from the ground, then the lever 12 can be rotated anti-clockwise again to release the grippers 23 from gripping the star picket flange S and lower the grippers 23 and to regrip the star picket at a lower position. A further lifting movement can then be initiated to further lift the star picket out of the ground. It will be appreciated that the grippers 23 will release their grip on the star picket as soon as the lever 12 is rotated in a clockwise direction and so there will be no return force tending to drive the star picket back into the ground.

Figure 2:
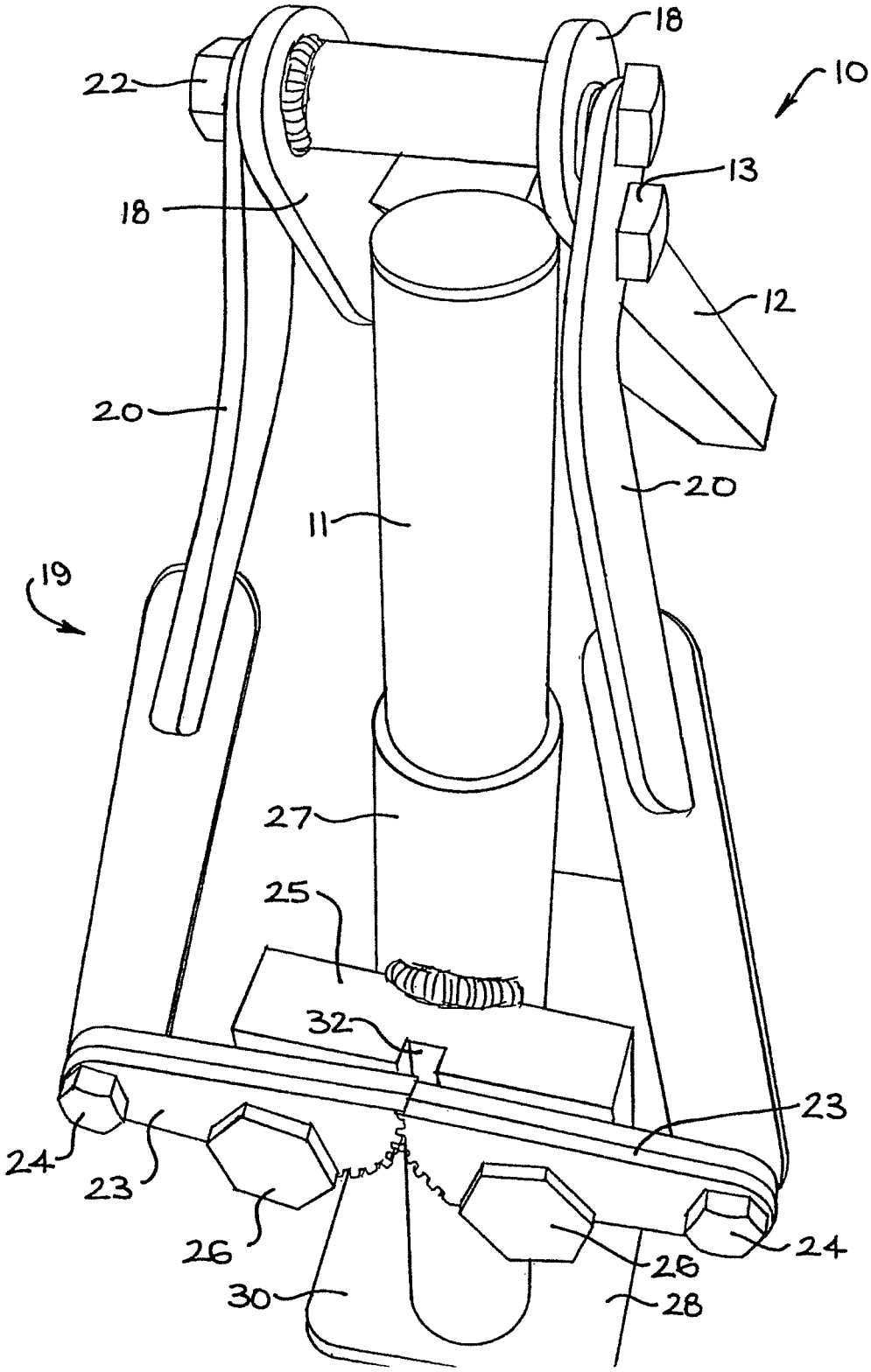
FIG. 2 is a perspective view of the post removal device of FIG. 1.

It can be noted from FIG. 2, that the mounting block 25 includes a recess 32 to accommodate an end portion of a star picket flange. It will be appreciated that the recess could take any suitable shape to accommodate any suitable shaped post.

The invention described herein is susceptible to variations, modifications and/or additions other than those specifically described and it is to be understood that the invention includes all such variations, modifications and/or additions which fall within the spirit and scope of the above description.

The invention claimed is:

1. A post removal device, comprising:

a rigid support which defines a fulcrum;

a lever which is rotatable about the fulcrum through a substantially vertical plane;

the lever extending on either side of the fulcrum to define a first portion on one side and a second portion on the other side, whereby downward rotational movement of the first portion results in upward rotational movement of the second portion;

the second portion is connected to a gripping mechanism which includes a pair of post grippers;

the post grippers are movable relative to each other during rotation of the lever, from an open condition in which there is a space between the grippers sufficient to accept a post, and a gripping condition in which the grippers grip the post; and the extent of rotational movement of the lever is sufficient for the grippers to move from the open condition to the gripping condition and for the gripping arrangement to be lifted with the grippers in the gripping condition for lifting a post, wherein the gripping mechanism includes a pair of arms each having a pivot connection to the second portion of the lever and another pivot connection respectively to a respective one of the post grippers, each post gripper having a rotatable mounting at a position spaced from the pivot connection with the respective arm, whereby the post grippers are driven to rotate about the rotatable mounting by the arms during a portion of the rotational movement of the lever.

2. A device according to claim 1, wherein movement of the post grippers between the open condition and the gripping condition is opposite rotational movement of each gripper.

3. A device according to claim 1, wherein the post grippers each include a gripping surface for gripping a post, the gripping surface being a curved, serrated surface.

4. A device according to claim 2, wherein the post grippers each include a gripping surface for gripping a post, the respective gripping surfaces moving towards each other during rotation of each gripper from the open condition to the gripping condition.

5. A device according to claim 1, wherein the post grippers frictionally grip the post.

6. A device according to claim 1, wherein the rotatable mounting of the grippers includes a sliding member slidably connected to the support, whereby each of the second portion, the pair of arms, the sliding member and the grippers move together during sliding movement of the sliding member and wherein rotational movement of the grippers between the open and closed conditions occurs when the second portion and the pair of arms move relative to the sliding member.

7. A device according to claim 1, wherein the first portion of the lever is significantly longer than the second portion.

8. A device according to claim 7, wherein the ratio between the first portion and the second portion is greater than 1 to 4.

9. A device according to claim 8, wherein the ratio is about 1 to 8.

10. A device according to claim 6, wherein the rigid support is a post member and the sliding member is a sleeve that extends about the post member for sliding movement relative to the post member.

11. A post removal device, comprising:

a rigid support which defines a fulcrum;

a lever which is rotatable about the fulcrum through a substantially vertical plane;

the lever extending on either side of the fulcrum to define a first portion on one side and a second portion on the other side, whereby downward rotational movement of the first portion results in upward rotational movement of the second portion;

the second portion is connected to a gripping mechanism which includes a pair of post grippers;

the post grippers are movable relative to each other during rotation of the lever, from an open condition in which there is a space between the grippers sufficient to accept a post, and a gripping condition in which the grippers grip the post;

the extent of rotational movement of the lever is sufficient for the grippers to move from the open condition to the gripping condition and for the gripping arrangement to be lifted with the grippers in the gripping condition for lifting a post;

wherein the gripping mechanism includes a pair of arms each having a pivot connection to the second portion of the lever and another pivot connection respectively to a respective one of the post grippers, each post gripper having a rotatable mounting at a position spaced from the pivot connection with the respective arm, whereby the post grippers are driven to rotate about the rotatable mounting by the arms during a portion of the rotational movement of the lever;

wherein the rotatable mounting of the grippers includes a sliding member slidably connected to the support, whereby each of the second portion, the pair of arms, the sliding member and the grippers move together during sliding movement of the sliding member and wherein rotational movement of the grippers between the open and closed conditions occurs when the second portion and the pair of arms move relative to the sliding member;

wherein the rigid support is a post member and the sliding member is a sleeve that extends about the post member for sliding movement relative to the post member; and wherein the post member is tubular and the sleeve is tubular and of an internal diameter which is greater than the external diameter of the post member.

12. A device according to claim 10, wherein the sliding member includes a mounting portion for rotatably mounting each of the grippers.

13. A device according to claim 12, wherein the mounting portion is a mounting block.

14. A device according to claim 1, wherein the rigid support is a post member and the fulcrum is formed on a side of the post member.

15. A post removal device, comprising:

a rigid support which defines a fulcrum;

a lever which is rotatable about the fulcrum through a substantially vertical plane;

the lever extending on either side of the fulcrum to define a first portion on one side and a second portion on the other side, whereby downward rotational movement of the first portion results in upward rotational movement of the second portion;

the second portion is connected to a gripping mechanism which includes a pair of post grippers;

the post grippers are movable relative to each other during rotation of the lever, from an open condition in which there is a space between the grippers sufficient to accept a post, and a gripping condition in which the grippers grip the post;

the extent of rotational movement of the lever is sufficient for the grippers to move from the open condition to the gripping condition and for the gripping arrangement to be lifted with the grippers in the gripping condition for lifting a post;

wherein the gripping mechanism includes a pair of arms each having a pivot connection to the second portion of the lever and another pivot connection respectively to a respective one of the post grippers, each post gripper having a rotatable mounting at a position spaced from the pivot connection with the respective arm, whereby the post grippers are driven to rotate about the rotatable mounting by the arms during a portion of the rotational movement of the lever; and wherein the rotatable mounting of the post grippers includes a sliding member slidably connected to the rigid support, the rigid support is a cylindrical post member and the sliding member is a circular sleeve of an internal diameter which is greater than the external diameter of the post member, the sleeve extends about the post member for sliding movement relative to the post member.

16. A device according to claim 15, wherein the fulcrum is formed on a side of the post member.

17. A post removal device, comprising:

a rigid support which defines a fulcrum;

a lever which is rotatable about the fulcrum through a substantially vertical plane;

the lever extending on either side of the fulcrum to define a first portion on one side and a second portion on the other side, whereby downward rotational movement of the first portion results in upward rotational movement of the second portion;

the second portion is connected to a gripping mechanism which includes a pair of post grippers;

the post grippers are movable relative to each other during rotation of the lever, from an open condition in which there is a space between the grippers sufficient to accept a post, and a gripping condition in which the grippers grip the post;

the extent of rotational movement of the lever is sufficient for the grippers to move from the open condition to the gripping condition and for the gripping arrangement to be lifted with the grippers in the gripping condition for lifting a post;

wherein the gripping mechanism includes a pair of arms each having a pivot connection to the second portion of the lever and another pivot connection respectively to a respective one of the post grippers, each post gripper having a rotatable mounting at a position spaced from the pivot connection with the respective arm, whereby the post grippers are driven to rotate about the rotatable mounting by the arms during a portion of the rotational movement of the lever; and wherein the rigid support is a post member and a sliding member formed as a sleeve is slidably connected to the post member, the sleeve being of an internal diameter which is greater than the external diameter of the post member so that the sleeve extends about the post member for sliding movement relative to the post member, the sliding member includes a mounting portion of the rotatable mounting that rotatably mounts each of the grippers, the mounting portion includes a recess to accommodate a portion of a post that is inserted between the grippers for gripping thereby.

18. A device according to claim 17, wherein the recess is for accommodating an end portion of a star picket flange.

* * * * *